US009567957B2

(12) United States Patent
Schmieder et al.

(10) Patent No.: US 9,567,957 B2
(45) Date of Patent: Feb. 14, 2017

(54) ELECTRICAL LEADS FOR A VALVE

(75) Inventors: Dietmar Schmieder, Markgroeningen (DE); Thomas Sebastian, Erdmannhausen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 308 days.

(21) Appl. No.: 14/239,011

(22) PCT Filed: Jul. 10, 2012

(86) PCT No.: PCT/EP2012/063471

§ 371 (c)(1),
(2), (4) Date: Jun. 17, 2014

(87) PCT Pub. No.: WO2013/026614

PCT Pub. Date: Feb. 28, 2013

(65) Prior Publication Data

US 2014/0312252 A1 Oct. 23, 2014

(30) Foreign Application Priority Data

Aug. 22, 2011 (DE) ..... 10 2011 081 343

(51) Int. Cl.
*F02M 51/06* (2006.01)
*F02M 51/00* (2006.01)
*F02M 61/08* (2006.01)

(52) U.S. Cl.
CPC ..... *F02M 51/0603* (2013.01); *F02M 51/005* (2013.01); *F02M 61/08* (2013.01)

(58) Field of Classification Search
CPC ... F02M 51/005; F02M 51/0603; F02M 61/08
(Continued)

(56) References Cited

U.S. PATENT DOCUMENTS 7,385,335 B2 * 6/2008 Biagetti ..... F02M 51/005 310/328
2002/0075597 A1 * 6/2002 Liu ..... G11B 5/486 360/234

FOREIGN PATENT DOCUMENTS

DE 103 17 148 10/2004
DE EP 1712774 A2 * 10/2006 ..... F02M 51/005
(Continued)

*Primary Examiner* — Marina Tietjen
*Assistant Examiner* — Daphne M Barry
(74) *Attorney, Agent, or Firm* — Norton Rose Fulbright US LLP; Gerard Messina

(57) ABSTRACT

A valve for metering a fluid (liquid or gaseous medium), in particular, a fuel injector for internal combustion engines, having a valve housing, an actuator accommodated in the valve housing and acting on a valve member, an electrical connector accessible on the outside of the valve housing, and an electrical supply lead that produces an electrical connection from the connector to the actuator and has two lead strands, each having a flexible strand section. To optimize the electrical supply lead to lower production costs, simplified valve assembly and anti-twist protection for the actuator, each lead strand is made of an electrical conductor provided with a plastic sheathing and having a front and rear, in each case elongated conductor section and a middle conductor section in between that has at least one meander-shaped curvature for realizing the flexible strand section, and a plastic bridge member, in one piece with the plastic sheathings in the area of the middle conductor sections of both electrical conductors, connects the two lead strands to form a torsionally stiff supply-lead module.

15 Claims, 2 Drawing Sheets

(58) Field of Classification Search
USPC ..... 251/11, 129.01
See application file for complete search history.

(56) References Cited

FOREIGN PATENT DOCUMENTS

| | | |
|---|---|---|
| DE | 10 2008 002197 | 12/2009 |
| EP | 1 712 774 | 10/2006 |
| EP | 2 043 172 | 4/2009 |
| JP | 9 213142 | 8/1997 |

* cited by examiner

ELECTRICAL LEADS FOR A VALVE

FIELD OF THE INVENTION

The present invention relates to a valve for metering a fluid, e.g., gaseous or liquid medium, particularly a fuel injector for internal combustion engines.

BACKGROUND INFORMATION

A fuel injector or fuel injection valve for the direct injection of fuel into the combustion chamber of an internal combustion engine (as in DE 103 17 148 A1) has a valve housing, a piezoelectric, electrostrictive or magnetostrictive actuator mounted on gimbals which is accommodated in the valve housing and is in operative connection with a valve needle, an electrical connector, and a supply lead producing an electrical connection from the connector to the actuator. The supply lead has two lead strands. Each lead strand is made up of an electrical conductor secured in position on the housing side, a contact pin which projects from the actuator and is disposed diametrically relative to the conductor in the valve housing, and a flexible strand section connecting the conductor to the contact pin.

The electrical conductor is a sheathed round wire that is passed through an endpiece closing the valve housing and having an inlet for the fuel, and the bare contact pin projects from the actuator on the front side. The flexible strand section has the form of a spring leaf which extends transversely to the axis of the valve housing. The spring leaf is soldered or welded with angled leaf ends to the bare end of the sheathed round wire on the one side, and on the other side to the bare contact pin. The flexible strand sections in the two lead strands in the form of spring leaves extending transversely to the axis of the valve housing keep unavoidable axial movements of the actuator—which come about owing to energizing of the actuator, different thermal expansions and unavoidable hydraulic losses of a coupler possibly disposed between the actuator and endpiece—away from the sheathed round wires secured in position in the endpiece, and thus prevent bending stresses and abrasions of the round wires and increase the resistance of the valve to wear.

SUMMARY OF THE INVENTION

The valve of the present invention having the features set forth herein has the advantage of a markedly simplified assembly, since the supply-lead module, producing in its entirety a complete wiring of the actuator, may be placed much more easily between the connector and the actuator, and only has to be welded at its conductor ends to the connector and actuator. Compared to the electrical supply lead in the known valve described at the outset, a total of four weldings, which are additionally necessary there in the two lead strands for the joining of each spring leaf to the round wire and contact pin, are omitted. The supply-lead module may be produced easily and inexpensively in a plastic injection-molding process with only two electrical conductors inserted and preformed in the middle line section. The desired axial length equalization in the lead strands to compensate for the axial actuator movements is accomplished via the axially offset curvatures of the middle conductor sections which, with their so-called wave geometry, represent the elastic and flexible strand sections of the lead strands. Given the customary gimbal mounting of the actuator in the valve housing, the torsionally stiff supply-lead module offers reliable protection against twisting for the actuator and makes additional measures for providing protection against twisting superfluous.

Advantageous further refinements of and improvements to the valve described herein are rendered possible by the measures specified in the further descriptions herein.

According to one advantageous specific embodiment of the invention, each middle conductor section has a plurality of axially offset, meander-shaped curvatures or waves, axially successive curvatures (36) pointing in inverse directions that extend perpendicularly to a plane in which front and rear conductor sections (341, 351, 342, 352) run. Owing to the plurality of axially offset, meander-shaped curvatures, a small axial spring stiffness of the supply-lead module is attained, so that in the event of an axial temperature-caused lift of the actuator, only very small lifting forces occur in the middle conductor sections.

According to one advantageous specific embodiment of the invention, the plastic bridge member has a plastic ring which delimits the middle conductor sections with respect to the elongated front conductor sections, and which is integrally molded in one piece onto the plastic sheathing of the front conductor sections, and a plastic disk segment delimiting with respect to the elongated rear conductor sections and having a central flow-through opening. The plastic disk segment is integrally molded in one piece onto the plastic sheathing of the rear conductor sections, and of both middle conductor sections, in each case one curvature branch—nearest to the plastic disk segment—of the meander-shaped curvature adjacent to the plastic disk segment is incorporated into the plastic disk segment. Due to this structural configuration of the plastic bridge member, a supply-lead module adapted optimally to the space available in the valve housing and having the greatest possible torsional stiffness may be realized, which is not an obstacle to the quest for compactness of the valve.

According to one advantageous specific embodiment of the invention, the plastic disk segment has a disk surface bounded by a circular arc and a chord of a circle, and is aligned in such a way that the circle chord extends parallel to the plane in which the front and rear conductor sections run. Each of the plastic sheathings of the two middle conductor sections extending between the plastic ring on one side and the plastic disk segment on the other side has a rectangular cross-section whose cross-sectional dimension running parallel to the chord of the plastic disk segment represents the largest cross-sectional dimension and is made markedly larger than the other cross-sectional dimension. The great width of the plastic sheathing thereby produced increases the torsional stiffness of the plastic bridge member.

According to one advantageous specific embodiment of the present invention, the electrical conductors are made of a round wire having a diameter of 0.5 mm, for example, or of a stamped sheet-metal part. A non-ferrous metal material, e.g., copper or tin, is used as material. A glass-fiber-reinforced polyamide, e.g., PA 66, may be used as plastic for the plastic sheathings and for the plastic bridge member.

According to one advantageous specific embodiment of the invention, the two electrical conductors are connected to each other in the area of the middle conductor sections by a high-value resistor. Such a resistor prevents electrical damage to the actuator upon valve assembly.

The present invention is explained in greater detail in the following description on the basis of an exemplary embodiment shown in the drawing, in which:

DETAILED DESCRIPTION

Figure 1:
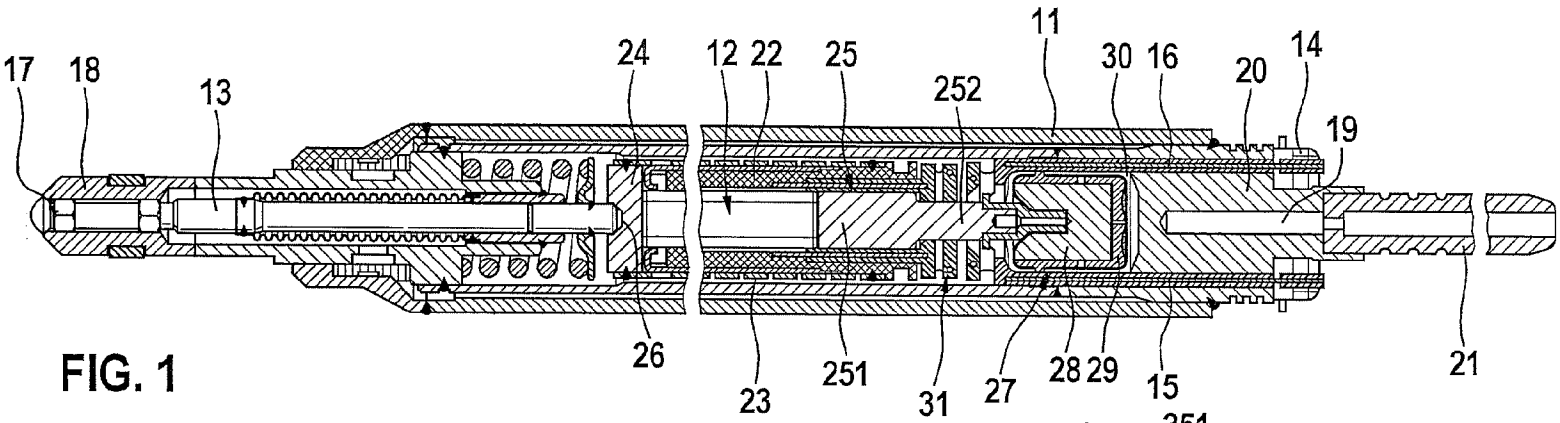
FIG. 1 shows a longitudinal section of a valve for metering a liquid or gaseous medium.
Figure 2:
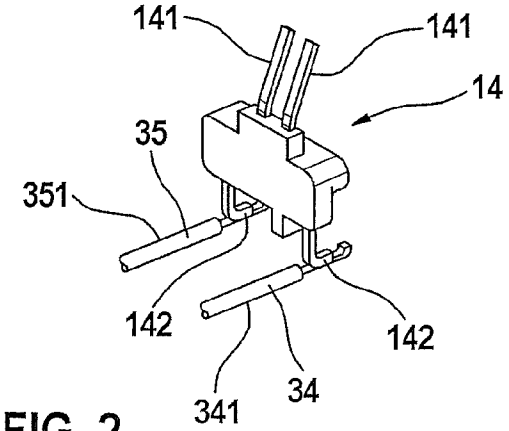
FIG. 2 shows a perspective representation of a connector in the valve according to FIG. 1.
Figure 4:
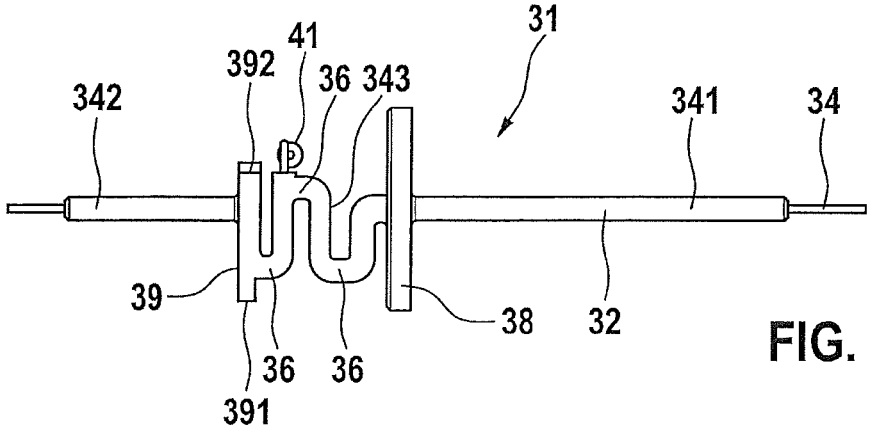
FIG. 4 shows a lateral view of the supply-lead module in FIG. 3.

The valve, shown in longitudinal section in FIG. 1, for metering a fluid medium, thus, a liquid or gaseous medium, may be used as an injection valve for injecting fuel into the combustion cylinder or air-induction tract of an internal combustion engine, but may also be used as a metering valve for injecting an aqueous solution, such as a urea-water solution, into the exhaust branch of an internal combustion engine. The valve has a hollow-cylindrical valve housing 11, an actuator 12 which is accommodated in valve housing 11 and acts on a valve member 13, a connector 14 which is accessible on the outside of valve housing 11 and is shown in perspective in FIG. 2, and a supply lead which produces an electrical connection from connector 14 to actuator 12 and has two lead strands 15, 16 having one flexible strand section each. Hollow-cylindrical valve housing 11 is closed at one end face by a valve body 18 having a metering opening 17, and at the other end face by a connecting piece 20 which has an inlet 19 for the medium and to which connector 14 is also attached. Disposed coaxially relative to inlet 19 is also a fitting 21, which is configured for slipping on an inlet hose. Metering opening 17 is controlled, thus closed or released, by a closing head of valve member 13 opening outwards. Actuator 12, acting to this end on valve member 13 to actuate it, takes the form here of a piezoelectric actuator and has an electrically controllable piezo stack 22 which is made up of piezoceramic disks and is clamped between an end plate 24 and a connecting body 25 by a hollow body 23 formed as a spring. Actuator 12 is supported via a gimbal mounting 26, which is formed at end plate 24 affixed to hollow body 23, at the end of valve member 13 remote from the closing head.

Terminating (connecting) body 25 of actuator 12 is graduated in terms of diameter and has a larger-diameter body section 251, to which hollow body 23 of actuator 12 is affixed, and a smaller-diameter body section 252, which is connected to a hydraulic coupler 27 situated between actuator 12 and connecting piece 20. The configuration and mode of operation of a hydraulic coupler are discussed, for example, in DE 10 2004 021 921 A1 or 10 2004 002 134 A1. In known manner, hydraulic coupler 27 has a piston 28 and a coupler housing 29 having a cylindrical piston guidance, as well as a coupler gap filled with fluid, which may be oil. In the exemplary embodiment shown, coupler housing 29 is mounted on gimbals in a recess 30 formed in connecting piece 20, and piston 28 is joined firmly to smaller-diameter body section 252 of terminating body 25 of actuator 12. Alternatively, coupler housing 29 may also be secured in recess 30 and a gimbal mounting may be provided between smaller-diameter body section 252 of terminating body 25 and piston 28 of hydraulic coupler 27.

Figure 3:
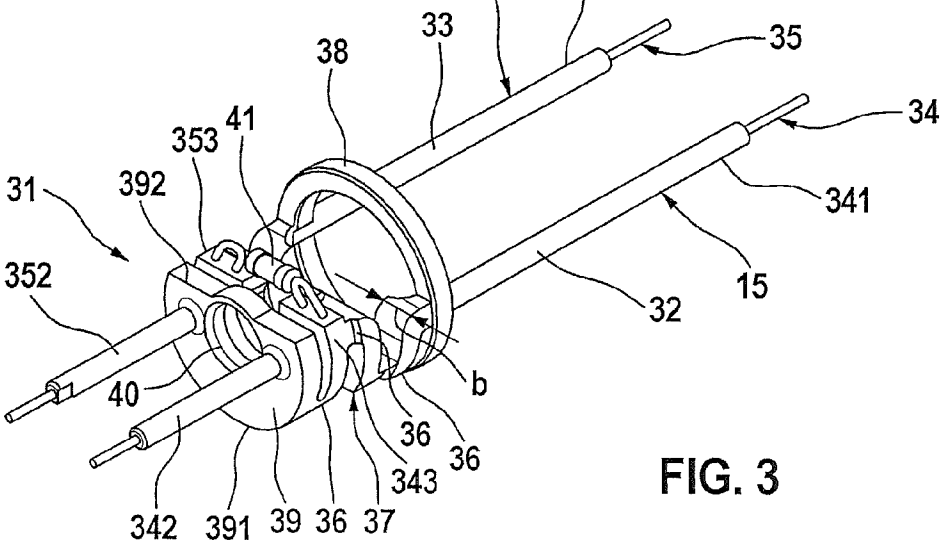
FIG. 3 shows a perspective representation of a supply-lead module in the valve according to FIG. 1.
Figure 5:
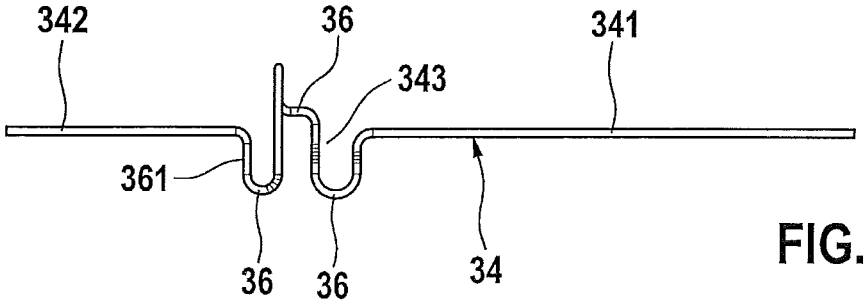
FIG. 5 shows a lateral view of an electrical conductor in the supply-lead module according to FIG. 4.
Figure 6:
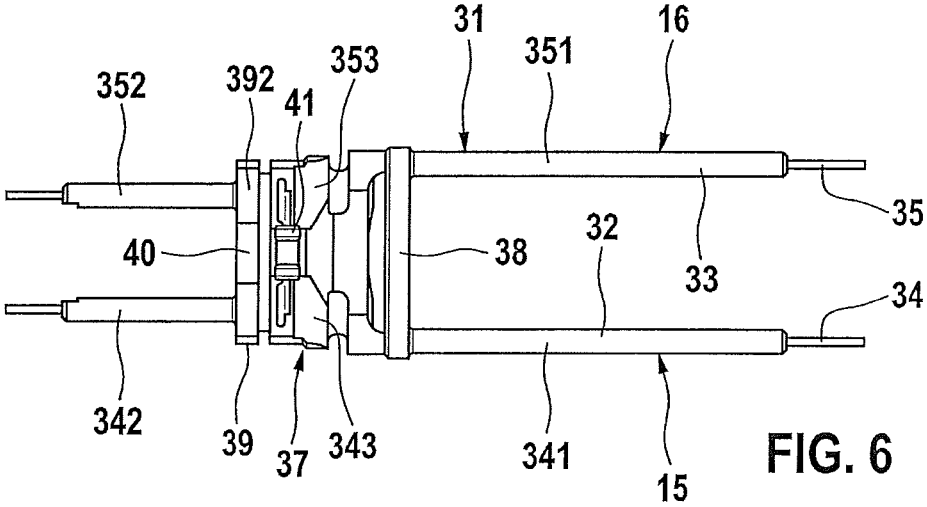
FIG. 6 shows a top view of the supply-lead module in FIG. 3.
Figure 7:
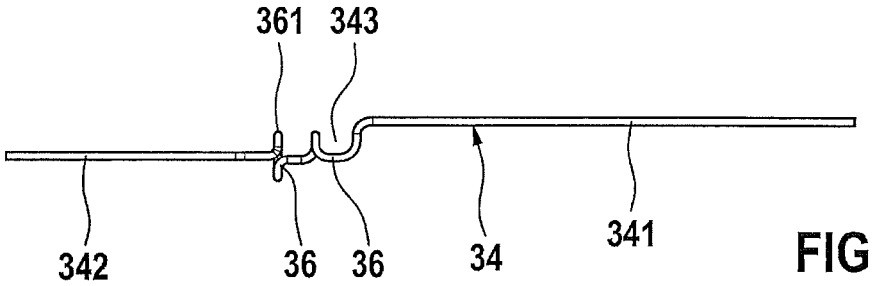
FIG. 7 shows a top view of an electrical conductor in the supply-lead module according to FIG. 6.

The electrical supply lead, made up of the two lead strands 15, 16, from connector 14 to actuator 12 is conceived as a torsionally stiff supply-lead module 31, as illustrated perspectively in FIG. 3, and simplifies and facilitates the assembly of the valve. Each lead strand 15 and 16 is made of an electrical conductor 34 and 35 provided with a plastic sheathing 32 and 33, respectively. Each electrical conductor 34, 35, of which unsheathed electrical conductor 34 is shown in lateral view in FIG. 5 and in top view in FIG. 7, is made up of an elongated front conductor section 341 and 351, respectively, which points toward connector 14, and an elongated rear conductor section 342 and 352, respectively, which points toward actuator 12, as well as a middle conductor section 343 and 353, respectively, situated in between. To realize the flexible and elastic strand section already mentioned at the outset, middle conductor sections 343 and 353 have at least one meander-shaped curvature 36 or undulation. In the exemplary embodiment shown, each middle conductor section 343 and 353 has a plurality of axially offset, meander-shaped curvatures 36, axially successive curvatures 36 pointing in inverse directions which extend perpendicularly to a plane in which front and rear conductor sections 341, 351, 342, 352 run. In the area of middle conductor sections 343, 353, a plastic bridge member 37, in one piece with plastic sheathings 32, 33, connects the two lead strands 15, 16 to each other, thereby yielding torsionally stiff supply-lead module 31.

In detail, plastic bridge member 37 has a plastic ring 38 delimiting middle conductor sections 343, 353 with respect to elongated front conductor sections 341, 351, and a plastic disk segment 39 delimiting middle conductor sections 343, 353 with respect to elongated rear conductor sections 342, 352. Plastic ring 38 is integrally molded in one piece onto plastic sheathings 32, 33 of front conductor sections 341, 351. Plastic disk segment 39 is integrally molded in one piece onto plastic sheathings 32, 33 of rear conductor sections 342, 352, and surrounds closer lying curvature branch 361 of the adjacent—in each case last in the strand course—meander-shaped curvatures 36 of the two middle conductor sections 343, 353. Plastic disk segment 39 has a disk surface bounded by a circular arc 391 and a chord of a circle 392, and is provided with a flow-through opening 40 for smaller-diameter body section 252 of terminating body 25 of actuator 12. Plastic disk segment 39 is aligned within supply-lead module 31 in such a way that the chord of a circle extends parallel to the plane in which front and rear conductor sections 341, 351, 342, 352 run.

In the area of front conductor sections 341, 351 and in the area of rear conductor sections 342, 352, plastic sheathings 32, 33 in each case have a circular cross-section, whereas in the area of middle conductor sections 343, 353, thus, between plastic ring 38 on one side and plastic disk segment 39 on the other side, in each case have a rectangular cross-section having a largest cross-sectional dimension running parallel to chord of s circle 392 of plastic disk segment 39. Due to this relatively wide cross-sectional dimension of plastic sheathing 32, 33, the area between plastic ring 38 and plastic disk segment 39 is additionally stiffened, so that all in all, plastic bridge member 37 is extremely torsionally stiff. Electrical conductors 34, 35 are produced from a round wire made of non-ferrous metal material or from a stamped sheet metal made of non-ferrous metal material. For instance, copper or tin is used as non-ferrous metal material. The round wire may have a diameter of 0.5 mm, for example. A glass-fiber-reinforced polyamide, e.g., PA 66, is used for plastic sheathings 32, 33 of electrical conductors 34, 35 and for plastic bridge member 37. For assembly purposes, the two electrical conductors 34, 35 are connected to each other in the area of middle conductor sections 343, 353 by a high-value resistor 41. The connection is accomplished by welding, soldering or clamping.

As can be seen in the sectional representation according to FIG. 1, after the valve has been assembled, elongated front conductor sections 341, 351 are secured in position in connecting piece 20 which bears connector 14, and elongated rear conductor sections 342, 352 are secured in position in larger-diameter body section 251 of terminating body 25 of actuator 12, in each case with form locking, while plastic bridge member 37 interconnecting middle conductor sections 343, 353 surrounds smaller-diameter body section 252 of terminating body 25 of actuator 12. Thus, actuator 12 is protected against twisting relative to valve housing 11 by torsionally stiff supply-lead module 31, which absorbs the torque occurring at actuator 12 during valve operation. Connector 14 has two electrical plug-in contacts 141 accessible on the outside of valve housing 11 and two contact tags 142 running from plug-in contacts 141 to connecting piece 20 closing valve housing 11. The bare ends of elongated front conductor sections 341, 351 of electrical conductors 34, 35 are each joined, e.g., by welding, to one of contact tags 142. The bare ends of elongated rear conductor sections 342, 352 of electrical conductors 34, 35 contact piezo stack 22 of actuator 12 directly.

What is claimed is:

1. A valve, which meters a fluid, including a liquid or gaseous medium, comprising:

a valve housing;

an actuator accommodated in the valve housing and acting on a valve member;

an electrical connector accessible outside of the valve housing; and an electrical supply lead that produces an electrical connection from the electrical connector to the actuator, the electrical supply lead having two lead strands, each having a flexible strand section, wherein each of the lead strands is made of an electrical conductor provided with a plastic sheathing and has a front and rear, in each instance an elongated conductor section and a middle conductor section in between which has at least one meander-shaped curvature that realizes the flexible strand section, and a plastic bridge member, in one piece with the plastic sheathings in an area of the middle conductor sections of both conductors, connects the two lead strands and forms a torsionally stiff supply-lead module, and wherein the actuator is supported via a gimbal mounting on a valve-member side and on a valve-housing side, respectively, and the elongated front conductor sections of the electrical conductors are secured in position in the valve housing, and the elongated rear conductor sections are secured in position in the actuator.

2. The valve of claim 1, wherein each of the middle conductor sections has a plurality of axially offset, meander-shaped curvatures, and axially successive curvatures point in inverse directions that extend perpendicularly to a plane in which the front and rear conductor sections run.

3. The valve of claim 2, wherein the plastic bridge member has a plastic ring that delimits the middle conductor sections with respect to the front conductor sections and is integrally molded in one piece onto the plastic sheathings of the front conductor sections, and a plastic disk segment which delimits the middle conductor sections with respect to the rear conductor sections and has a central flow-through opening, the plastic disk segment being integrally molded in one piece onto the plastic sheathings of the rear conductor sections, and in each instance integrating a nearest curvature branch of the adjacent meander-shaped curvatures of the two middle conductor sections.

4. The valve of claim 3, wherein the plastic disk segment has a disk surface bounded by a circular arc and a chord of a circle and is aligned causing the chord of a circle extends parallel to the plane in which the front and rear conductor sections run.

5. The valve of claim 4, wherein the plastic sheathings of each of the middle conductor sections extending between the plastic ring on one side and the plastic disk segment on the other side have a rectangular cross-section with a largest cross-sectional dimension running parallel to the chord of a circle of the plastic disk segment.

6. The valve of claim 1, wherein each electrical conductor is produced from a round wire made of a non-ferrous metal material, including copper or tin.

7. The valve of claim 6, wherein the round wire has a diameter of 0.5 mm.

8. The valve of claim 1, wherein each of the electrical conductors is implemented as a stamped sheet metal part made of a non-ferrous metal material, including copper or tin.

9. The valve of claim 1, wherein a glass-fiber-reinforced polyamide is used as material for the plastic sheathings and the plastic bridge member.

10. The valve of claim 1, wherein the two electrical conductors are connected to each other in the area of the middle conductor sections by a high-value resistor.

11. The valve of claim 1, wherein the gimbal mounting of the actuator on the valve-housing side is accomplished via a hydraulic coupler that is accommodated in a connecting piece which closes the valve housing and has a fitting for the medium, the actuator has a terminating body that is graduated in terms of diameter, having a larger-diameter and a smaller-diameter body section, whose smaller-diameter body section is connected to the hydraulic coupler, and the supply-lead module is placed in the valve housing causing the plastic bridge member to surround the smaller-diameter body section, and the front conductor sections are passed through the connecting piece and the rear conductor sections are passed through the larger-diameter body section, in each case with form locking.

12. The valve of claim 11, wherein the electrical connector has two electrical plug-in contacts accessible on the outside of the valve housing and two contact tags running from the plug-in contacts to the connecting piece, and the actuator has a piezo stack, and the supply-lead module contacts one contact tag each of the electrical connectors with bare ends of the front conductor sections of the electrical conductors, and with bare ends of the rear conductor sections of the electrical conductors, contacts the piezo stack directly.

13. The valve of claim 1, wherein the valve is a fuel injector for an internal combustion engine.

14. A valve, which meters a fluid, including a liquid or gaseous medium, comprising:

a valve housing;

an actuator accommodated in the valve housing and acting on a valve member;

an electrical connector accessible outside of the valve housing; and an electrical supply lead that produces an electrical connection from the electrical connector to the actuator, the electrical supply lead having two lead strands, each having a flexible strand section;

wherein each of the lead strands is made of an electrical conductor provided with a plastic sheathing and has a front and rear, in each instance an elongated conductor section and a middle conductor section in between which has at least one meander-shaped curvature for realizing the flexible strand section, and a plastic bridge member, formed in one piece with the plastic sheathings in an area of the middle conductor sections of both conductors, connects the two lead strands to form a torsionally stiff supply-lead module; and wherein the plastic bridge member includes a closed plastic ring formed in one piece with a plastic disk segment, the plastic bridge being torsionally stiff.

15. A valve, which meters a fluid, including a liquid or gaseous medium, comprising:

a valve housing;

an actuator accommodated in the valve housing and acting on a valve member;

an electrical connector accessible outside of the valve housing; and an electrical supply lead that produces an electrical connection from the electrical connector to the actuator, the electrical supply lead having two lead strands, each having a flexible strand section;

wherein each of the lead strands is made of an electrical conductor provided with a plastic sheathing and has a front and rear, in each instance an elongated conductor section and a middle conductor section in between which has at least one meander-shaped curvature for realizing the flexible strand section, and a plastic bridge member, formed in one piece with the plastic sheathings in an area of the middle conductor sections of both conductors, connects the two lead strands to form a torsionally stiff supply-lead module; and wherein the plastic bridge member includes a closed plastic ring that delimits the middle conductor sections with respect to the front conductor sections and is integrally molded in one piece onto the plastic sheathings of the front conductor sections, and a plastic disk segment which delimits the middle conductor sections with respect to the rear conductor sections and has a central flow-through opening, the plastic disk segment being integrally molded in one piece onto the plastic sheathings of the rear conductor sections, the plastic bridge being torsionally stiff.

* * * * *